US005888953A

United States Patent [19]

Harris et al.

[11] Patent Number: 5,888,953

[45] Date of Patent: Mar. 30, 1999

[54] USE OF MICROWAVE ENERGY TO FORM SOAP BARS

[75] Inventors: Eugene G. Harris, West Chester; J. Matthew White, Morrow, both of Ohio

[73] Assignee: Henkel Corporation, Plymouth Meeting, Pa.

[21] Appl. No.: 869,046

[22] Filed: Jun. 4, 1997

[51] Int. Cl.[6] ..... C11D 17/00; C11D 13/00; C11D 13/10; C11D 11/00

[52] U.S. Cl. ..... 510/153; 510/450; 510/481; 510/491

[58] Field of Search ..... 510/130, 141, 510/153, 152, 155, 407, 447, 450, 481, 491

[56] References Cited

FOREIGN PATENT DOCUMENTS 4404633 8/1995 Germany .

WO 97/43399 11/1997 WIPO .

*Primary Examiner*—Paul Lieberman
*Assistant Examiner*—John M. Petruncio
*Attorney, Agent, or Firm*—Ernest G. Szoke; Wayne C. Jaeschke; Steven J. Trzaska

[57] ABSTRACT

A process for making a soften or fluid personal cleansing composition comprising: (a) providing a solid personal cleansing stock consisting essentially of an acyl isethionate; (b) heating the solid personal cleansing stock using microwave energy to form a softened or molten stock personal cleansing component; (c) introducing the softened or molten stock personal cleansing into a mixing apparatus; (d) introducing a personal cleansing adjuvant into the mixing apparatus; and (e) mixing the softened or molten personal cleansing stock and adjuvant in the mixing apparatus to form a softened or fluid personal cleansing composition.

18 Claims, No Drawings

USE OF MICROWAVE ENERGY TO FORM SOAP BARS

FIELD OF THE INVENTION

The present invention generally relates to a process for heating soap stock. More particularly, the present invention is directed to a process for speedily softening and liquefying the solid soap stock in a manner which reduces the likelihood of soap stock degradation.

BACKGROUND OF THE INVENTION

The cleansing of skin with surface-active cleansing preparations has become a focus of great interest. Many people wash and scrub their skin with various surface-active preparations several times a day. Ideal skin cleansers should cleanse the skin gently, causing little or no irritation, without defatting and overdrying the skin or leaving it, taut after frequent routine use. Most lathering soaps, liquids and bars included, fail in this respect.

Synthetic detergent bars, frequently referred to as "syndet bars", are well known and are becoming increasingly popular. However, widespread replacement of soap bars by syndet bars has been difficult for a variety of reasons, primarily the poor physical characteristics of syndet bars as compared to soap bars. In clear distinction from syndet bars which are "soap-free" are the so-called "combo" bars which are combinations of fatty acid salts and synthetic detergents. One type of combo bar is produced by combining fatty acid soaps with salts of acyl isethionates. These combo bars, because they contain both a synthetic detergent and a soap component, do not suffer from the poor physical characteristics of syndet bars, and are milder to human skin than traditional fatty acid soaps.

However, a problem encountered in manufacturing combo bars relates to the incorporation of the synthetic acyl isethionates into the fatty acid soap. Acyl isethionates are high melting solids with low solubility in either water or organic solvents. Aqueous solutions of sodium cocoyl isethionate are inherently highly viscous. Thus, it is very difficult to incorporate acyl isethionates into soap formulations without the attendant physical disadvantages associated with their poor handling properties.

SUMMARY OF THE INVENTION

The present invention is directed to a process for making a fluid personal cleansing composition involving the steps of:

(a) providing a solid stock personal cleansing component consisting essentially of an acyl isethionate;

(b) heating the solid stock personal cleansing component using microwave energy to form a soft/molten personal cleansing stock;

(c) introducing the soft/molten personal cleansing stock into a mixing apparatus;

(d) introducing a personal cleansing adjuvant into the mixing apparatus; and (e) mixing the soft/molten personal cleansing stock and adjuvant in the mixing apparatus to form a personal cleansing product.

DESCRIPTION OF THE INVENTION

Other than in the operating examples, or where otherwise indicated, all number expressing quantities of ingredients or reaction conditions used herein are to be understood as being modified in all instances by the term "about".

It has been surprisingly discovered that by using microwave energy to heat personal cleansing stock, in solid form, prior to the formation of personal cleansing finished products such as toilet bars, the viscosity of the solid personal cleansing components is lowered thereby making them easier to handle, i.e., formulate into finished products. Moreover, the degree of degradation resulting from the use of high temperatures during the conventional heating of solid personal cleansing components is significantly reduced and/or eliminated.

The stock personal cleansing component, in solid form, of the present invention contains at least an acyl isethionate corresponding to formula I:

$$RCO—OCH_2CH_2—SO_3Z \quad (I)$$

wherein RCO is a linear or branched acyl radical having from about 6 to about 22 carbon atoms and Z is selected from the group consisting of an alkali metal, an alkaline earth metal and ammonium. These esters may be prepared by reacting an alkali metal, alkaline earth metal or ammonium isethionate with a mixture of aliphatic fatty acid(s) having from 8 to 22 carbon atoms. In a particularly preferred embodiment, the acyl isethionate is sodium cocoyl isethionate.

The acyl isethionate is available in particulate form such as for example, flakes, and the content of acyl isethionate is from about 50 to about 75% by weight. This particulate material contains minor amounts of unmodified reactants such as fatty acids and sodium or potassium isethionate. Typically, the concentration of fatty acids ranges from 20% to 45% by weight and the concentration of isethionate salt ranges from 1% to 4% by weight. Water is also usually present in the range of from 0.5% to about 1.5% by weight. The included quantity of isethionate salt does not adversely affect the resultant finished personal cleansing substrate whether in bar or liquid form.

Additional solid personal cleansing components may also be admixed with the acyl isethionate to form the solid stock personal cleansing component of the invention. These additional solid personal cleansing components may be selected from the group consisting of free $C_{12}$–$C_{24}$ fatty acids, soap, and mixtures thereof.

The free fatty acids which may be employed in the present invention are carboxylic acids derived from or contained in an animal or vegetable fat or oil. They are composed of a chain of alkyl groups containing from 8 to 22 carbon atoms and are characterized by a terminal carboxyl group. A particularly preferred free fatty acid for use in the present invention is a stripped coconut fatty acid wherein the volatile components of coconut fatty acid are removed by distillation.

The soaps which may be employed in the present invention are generally sodium or potassium salts of natural or synthetic aliphatic (alkanoic or alkenoic) acid having a carbon chain length of from about 8 to about 20 carbon atoms. Examples of triglyceride sources providing soaps with carbon chain lengths in this range include, for example, coconut oil, palm kernel oil, babassu oil, tallow, palm oil, rice bran oil, groundnut oil and rapeseed oil.

Preferred soap mixtures are prepared from coconut oil and tallow and comprise about 50% to 90% by weight of tallow fatty acids and about 10% to about 50% by weight of coconut oil fatty acids. Such mixtures contain more than 90% by weight of fatty acids having carbon chain lengths in the $C_{12}$ to $C_{18}$ range.

Soaps may be made by the classic kettle boiling process or fatty acid neutralization process or by more modern continuous soap manufacturing processes. These processes typically produce a neat soap containing from about 65% to 70% by weight of sodium soap, up to about 1.5% by weight of glycerine, up to about 1% by weight of salt such as sodium chloride, and the balance, water. Usually, neat soap is employed in the described process.

In a particularly preferred embodiment of the present invention, the personal cleansing stock, in solid form, contains from about 1 to about 65% by weight, and preferably from about 10 to about 55% by weight of an acyl isethionate, from about 0.1 to about 30% by weight, and preferably from about 2 to about 10% by weight, of free fatty acid, and from about 5 to about 99% by weight, and preferably from about 20 to about 95% by weight, of a soap, all weights being based on the total weight of the solid personal cleansing stock.

The personal cleansing adjuvants which may be employed in the present invention are generally selected from the group consisting of anionic surfactants such as alkylbenzene sulfonates, alkyl sulfates and alkane sulfonates, nonionic surfactants such as alkyl polyglycosides, fillers such as starch, antibacterial agents, fluorescers, dyes or pigments, polymers, perfumes, polyols such as glycerin, and mixtures thereof. The amount of adjuvant(s) which may be used will depend on the particular desires of those skilled in the personal cleansing product art.

The process of the invention involves heating the stock personal cleansing component, in solid form, until it becomes soft or molten, thereby decreasing its viscosity and making it significantly easier to handle (mix), through the use of microwave energy. The microwaves generally have a wave length between about 0.3 and 30 centimeters, corresponding to frequencies of from 1 to 100 gigahertz. The solid stock component is first heated using microwaves until it becomes soft or molten enough to insure mixing.

The soft or molten stock component is then introduced into a mixing apparatus, such as an amalgamator, along with an adjuvant. The molten stock component and adjuvant(s) are then mixed in the amalgamator to form a fluid finished personal cleansing product. The fluid finished personal cleansing product thus formed may then be processed into a personal cleansing bar (toilet bar). It should be noted, however, that the finished personal cleansing product can also be employed by the consumer in either liquid or gel form.

The present invention will be better understood from the examples which follow, all of which are intended to be illustrative only and not meant to unduly limit the scope of the invention. Unless otherwise indicated, percentages are on a weight-by-weight basis.

EXAMPLE 1

The following solid stock personal cleansing components can be heated into a softer form using microwave energy.

| Component | Solids Content |
|---|---|
| (a) sodium cocoyl isethionate | 15.00 |
| (b) coconut fatty acid | 5.00 |
| (c) commercial soap pellets | 80.00 |
| | 100.00 |

Once they have been heated into a softened form, they may then be inserted into an amalgamator, along with a perfume adjuvant, and mixed to form a fluid finished personal cleansing product having superior tactile properties. The finished personal cleansing product may then be formed into toilet bars using conventional means.

What is claimed is:

1. A process for making a fluid personal cleansing composition comprising:

(a) providing a solid personal cleansing component consisting essentially of an acyl isethionate;

(b) heating the solid personal cleansing component using microwave energy to form a softened or molten personal cleansing stock;

(c) introducing the softened or molten personal cleansing component into a mixing apparatus;

(d) introducing a personal cleansing adjuvant into the mixing apparatus; and (e) mixing the softened or molten personal cleansing component and adjuvant in the mixing apparatus to form a fluid personal cleansing composition.

2. The process of claim 1 wherein the solid personal cleansing component further contains a second cleansing component selected from the group consisting of a $C_{12}$–$C_{24}$ free fatty acid, soap, and mixtures thereof.

3. The process of claim 2 wherein the $C_{12}$–$C_{24}$ free fatty acid is present in the solid personal cleansing component in an amount of from about 1% to about 30% by weight, based on the weight of the solid personal cleansing stock.

4. The process of claim 2 wherein the soap is present in the solid personal cleansing component in an amount of from about 5% to about 99% by weight, based on the weight of the solid personal cleansing stock.

5. The process of claim 1 wherein the personal cleansing adjuvant is selected from the group consisting of an anionic surfactant, a nonionic surfactant, a filler, an antibacterial agent, a fluorescer, a dye or pigment, a polymer, a perfume, a polyol, and mixtures thereof.

6. The process of claim 1 wherein the mixing apparatus is an amalgamator.

7. The process of claim 1 further comprising forming the softened or molten personal cleansing composition into a toilet bar.

8. A process for making a softened or fluid personal cleansing composition comprising:

(a) providing a solid personal cleansing stock consisting essentially of:

(i) from about 1 to about 65% by weight of a sodium cocoyl isethionate;

(ii) from about 1 to about 30% by weight of a $C_{12}$–$C_{24}$ free fatty acid; and (iii) from about 5 to about 99% by weight of soap, all weights being based on the weight of the solid personal cleansing stock;

(b) heating the solid personal cleansing stock using microwave energy to form a softened or molten personal cleansing stock;

(c) introducing the softened or molten personal cleansing stock into an amalgamator;

(d) introducing a personal cleansing adjuvant into the amalgamator; and (e) mixing the softened or molten stock personal cleansing stock and adjuvant in the amalgamator to form a softened or fluid personal cleansing composition.

9. The process of claim 8 further comprising forming the softened or fluid personal cleansing composition into a toilet bar.

10. The product of the process of claim 1.

11. The product of the process of claim 2.

12. The product of the process of claim 3.

13. The product of the process of claim 4.

14. The product of the process of claim 5.

15. The product of the process of claim 6.

16. The product of the process of claim 7.

17. The product of the process of claim 8.

18. The product of the process of claim 9.

* * * * *